US008098025B2

(12) United States Patent
Chung

(10) Patent No.: US 8,098,025 B2
(45) Date of Patent: Jan. 17, 2012

(54) LED FLASH BULB DECORATING LIGHT

(75) Inventor: Wen-Chen Chung, Hsinchu (TW)

(73) Assignee: Excellence Opto. Inc., Hsinchu (TW)

( * ) Notice: Subject to any disclaimer, the term of this patent is extended or adjusted under 35 U.S.C. 154(b) by 239 days.

(21) Appl. No.: 12/591,702

(22) Filed: Nov. 30, 2009

(65) Prior Publication Data

US 2011/0127918 A1 Jun. 2, 2011

(51) Int. Cl.
*G05F 1/00* (2006.01)

(52) U.S. Cl. ..... 315/294; 315/291; 315/312; 315/360; 315/185 S; 315/185 R; 362/227; 362/249.06; 362/249.02; 362/249.16; 362/800

(58) Field of Classification Search ..... 315/185 S, 315/185 R, 187, 192, 200 A, 216, 226, 291, 315/294, 209 R, 307, 312, 320, 360; 362/227, 362/555, 565, 568, 800, 806, 249.02, 249.06, 362/249.14, 249.19

See application file for complete search history.

(56) References Cited

U.S. PATENT DOCUMENTS

| | | | | |
|---|---|---|---|---|
| 7,021,808 | B2 * | 4/2006 | Currie et al. | 362/551 |
| 7,192,160 | B2 * | 3/2007 | Reiff et al. | 362/231 |
| 2005/0024877 | A1 * | 2/2005 | Frederick | 362/277 |
| 2009/0309504 | A1 * | 12/2009 | Hsu | 315/185 S |
| 2010/0237788 | A1 * | 9/2010 | Tsai | 315/187 |

* cited by examiner

*Primary Examiner* — Haiss Philogene
(74) *Attorney, Agent, or Firm* — Bacon & Thomas, PLLC

(57) ABSTRACT

A LED flash bulb decorating light with features of able to achieve complicated light variation by employing simple circuit design, which comprises a power cord with a power plug, a series of single color, dual color or multiple color LED flash bulb forming in series or parallel circuit with the power cord. And a circuit control box comprises a low pass filter circuit and a power reset circuit and installed between the power plug of the power cord and the LED flash bulb, wherein the LED flash bulb at least comprises a LED chip and an IC driving element for driving the LED chip with DC power according to the setting time sequence to generate desired light variation. And the power reset circuit reset power supply at the repeated setting time interval to enable each LED flash bulb on the power cord to restart flash sequence to maintain the desired synchronous light variation.

9 Claims, 5 Drawing Sheets

LED FLASH BULB DECORATING LIGHT

BACKGROUND OF THE INVENTION

1. Field of the Invention

The invention relates to a LED flash bulb decorating light, particularly the LED flash bulb decorating light is equipped with power reset circuit.

2. Description of the Prior Art

As is known to all, a conventional LED decorating light 10 shown in FIG. 1 comprises an electric power plug 12, a power cord 11, a control box 13 and one or more set of LED light strings 14, and each LED light string has specific number of LED bulbs 15.

And, the control box 13 comprises a micro control unit (MCU), and more than one output connecting port Pn and a common connecting port Pcom. Each connecting port Pn forms a light string circuit, and can be connected to a set of LED light string 14. The power output from each output port Pn is controlled by the MCU.

Hence, after the conventional LED decorating light 10 is connected to AC power supply through the power plug 12 of power cord 11, the power output from each output port Pn can be controlled by the MCU of the control box 13 according to the designed program to generate an effect of ON-OFF variation of the LED bulb 15 on the LED light string 14.

However, since the conventional LED decorating light 10 comprises too many LED light strings 14 that cause the power cord of LED light string 14 is easy to get entangled. Moreover, the LED bulb 15 on each LED Light string 14 always synchronously undergoes an ON-OFF variation in the same model, particularly each different LED bulb 15 on the same LED light string 14 can not undergo ON-OFF variation independently in a model different from each other, resulted in that the conventional LED decorating light 10 is less vivid and too monotonous in LED light variation.

SUMMARY OF THE INVENTION

For improvement, a novel LED decorating light of the invention is improved without using of programmable MCU to control the designed LED light variation and no longer having too many power cords entangled together.

The novel LED decorating light of the invention includes an improved LED bulb incorporating with an ON-OFF timing control IC (hereinafter called LED flash bulb). And the LED flash bulb is controlled by an ON-OFF timing control IC programmable to undergo LED light variation. Also the power supply of the LED flash bulb is reset by the power reset circuit at a repeated interval of time, so that the starting time for each of the independently operated LED flash bulb can always be maintained at synchronous sequence, and a complicated variation model of decorating light can be achieved by means of a simple circuit design.

The major purpose of the invention is to provide a LED flash bulb decorating light which comprises a power cord with a plug, more than one LED flash bulbs with single color, dual color or multiple colors to be forming in series or parallel circuit with the power cord. And a circuit control box is installed between the power plug of the power cord and the LED flash bulbs. The circuit control box has a low pass filter circuit and a power reset circuit. The AC power input from the power plug of the power cord is rectified into DC power through the low pass filter circuit. The power reset circuit comprises a power reset IC element and two transistors Q1 and Q2, and the power reset function is executed at the repeated setting time interval so that the ON-OFF sequence of each LED flash bulb installed on the power cord in series or in parallel can be maintained at the desired synchronous variation, and a complicated variation of decorating light can be achieved by simple circuit design.

The single color LED flash bulb comprises a LED chip of single color and an IC driving element, and the IC driving element is for driving the LED chip by DC power according to the pre-determined light variation timing sequence to generate single color light variation.

The dual color LED flash bulb comprises two LED chips of different color and an IC driving element. The IC driving element is for driving the two LED chips by DC power according to the pre-determined light variation timing sequence to generate dual color light variation.

The multiple color LED flash bulb comprises three LED chips of red, green and blue color and an IC driving element. The IC driving element is for driving the three LED chips by DC power according to the pre-determined light variation time sequence to generate multiple color light variation.

The LED flash bulb decorating light of the invention may also comprise a DC power zener circuit formed in the circuit control box.

The LED flash bulb decorating of the invention may further comprise a DC power socket connected to the power cord.

The LED flash bulb decorating light of the invention has the following advantages.

1. Doesn't need to use MCU (micro processor) for control;
2. Each LED flash bulb has its own independent IC driving element for driving its own LED chip(s) that causes the LED flash bulb decorating light of the invention become more functional assembly and variation.
3. Complicated light variation can be achieved by simple circuit design.
4. By employing simple power reset circuit design, the starting time of each independently operated LED flash bulb can be maintained in conformity with the pre-determined sequence that can achieve the effect of synchronous variation of the LED flash bulb.
5. The circuit and model design of the LED flash bulb decorating light is so simple and easy that the LED flash bulb decorating light of the invention can be formed with less wire and circuit.

DESCRIPTION OF THE PREFERRED EMBODIMENT

Figure 1:
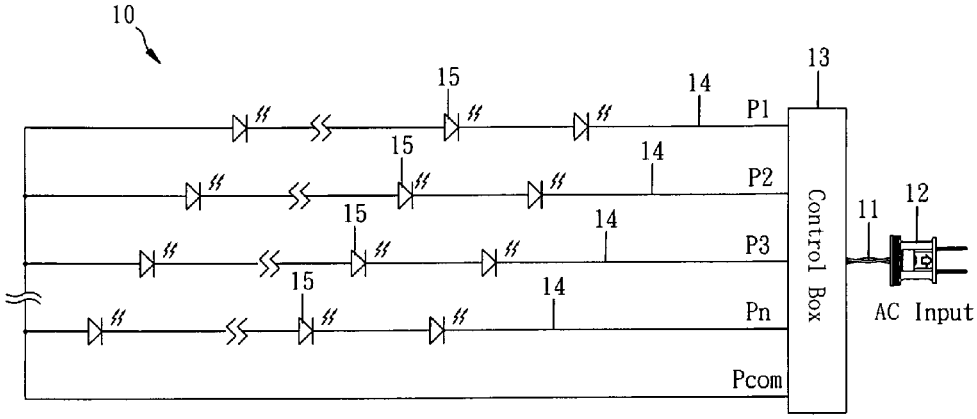
Fig. 1 (prior art)
FIG. 1 is a schematic drawing to illustrate the structure of a conventional LED decorating light.
Figure 2:
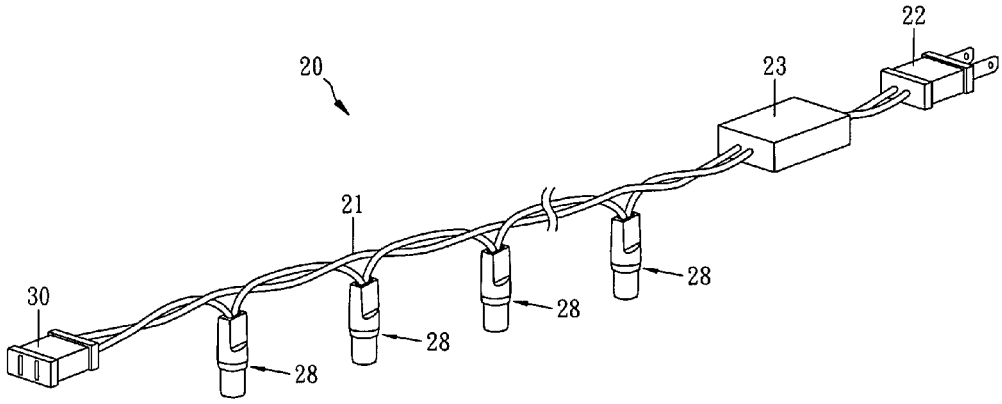
FIG. 2 is a perspective drawing of the LED flash bulb decorating light of the invention.
Figure 3:
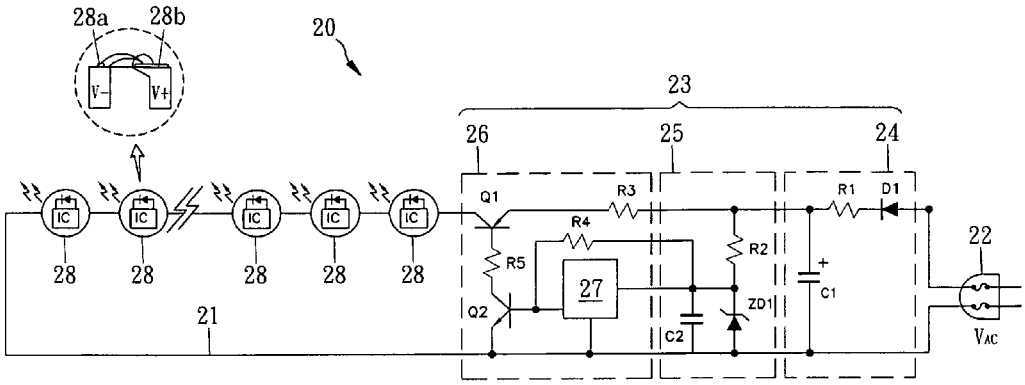
FIG. 3 is a circuit diagram employed on the LED flash bulb decorating light shown in FIG. 2 and further includes an enlarged diagram to illustrate a single color LED flash bulb provided with a LED chip and an IC driving element for driving the LED chip.
Figure 4:
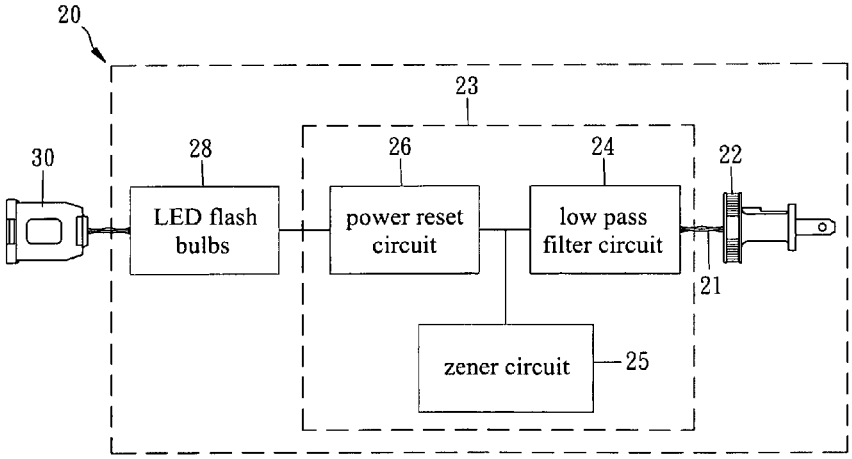
FIG. 4 is a control block diagram of the LED flash bulb decorating light shown in FIG. 2.

Shown from FIG. 2 to FIG. 4, the LED flash bulb decorating light 20 of the invention comprises a power cord 21, a circuit control box 23 and a series of single or multiple color LED flash bulbs 28, wherein the circuit control box 23 at least comprises a low pass filter circuit 24 and a power reset circuit 26, or further includes a zener circuit 25 according to practical needs.

The power cord 21 has a power plug 22 for connecting an AC power source and the circuit control box 23 is installed on the power cord 21 behind the power plug 22.

The AC power input from the power plug 22 connected to an AC power source is rectified by low pass filter circuit 24 of the circuit control box 23 to become DC power which supplied the single or multiple color LED flash bulb 28 installed on the power cord 21 to be forming series or parallel circuit. In particular, the circuit control box 23 also has the power reset circuit 26 to execute power reset function which may automatically stop DC power supply and promptly reset DC power supply to the single or multiple color flash bulb 28 at the repeated setting time interval.

Shown in FIGS. 2 and 4, another exemplary embodiment of the LED flash bulb 20 of the invention further comprises a socket 30 installed on one end of the power cord 21 for supplying DC power.

Shown in FIG. 3, the low pass filter circuit 24 designed in the circuit control box 23 is constructed by a diode D1, a resistor Q1 and a capacitor C1. The AC power input from the power plug 22 of the power cord 21 is rectified by the diode D1 and is filtrated by the filter formed by the resister R1 and capacitor C1 to become DC power.

The zener circuit 25 is constructed by a zener diode ZD1 and a capacitor C2, or further includes a resistor R2 according to practical needs. When AC voltage is fluctuant, the zener diode ZD1 can stabilize the DC power voltage output from the low pass filter circuit 24 to maintain stable voltage output.

The power reset circuit 26 is positioned behind the low pass filter circuit 24 and the zener circuit 25. The DC power output from the low pass filter 24 is stabilized by the zener circuit 25 to become an effective power for the power reset circuit 26.

The power reset circuit 26 has functions of power switch and power reset, which comprises a power reset IC element 27 and two diodes Q1 and Q2, or further includes three resistors R2, R4 ad R5 as shown in FIG. 3 according to practical needs.

The power reset IC 27 is a control element for executing power reset function at a setting time interval repeatedly and cyclically.

The transistors Q1 and Q2 are used as power switch. Within the time interval between repeatedly and cyclically executing power reset by the power reset IC element 27, DC power through the transistors Q1 and Q2, which is effectively supplied to each LED flash bulb 28 of the LED flash bulb decorating light 20 of the invention. When the power reset IC element 27 executes the power reset function, the transistors Q1 and Q2 will instantaneously stop DC power supply, and then immediately restart to supply DC power to the single or multiple color LED flash bulb 28.

The LED flash bulb 28 is a kind of LED bulb having an IC element installed inside the bulb. Single color LED flash bulb 28 referring to FIG. 3 comprises a single color LED chip 28*a* and an IC driving element 28*b*, wherein the IC driving element 28*b* is an integrated circuit for controlling the ON-OFF flash timing sequence of the LED chip 28*a*. When DC power flows into the IC driving element 28*b* from power cord 21, the LED chip 28*a* will generate single color light and undergo ON-OFF variation.

Figure 5:
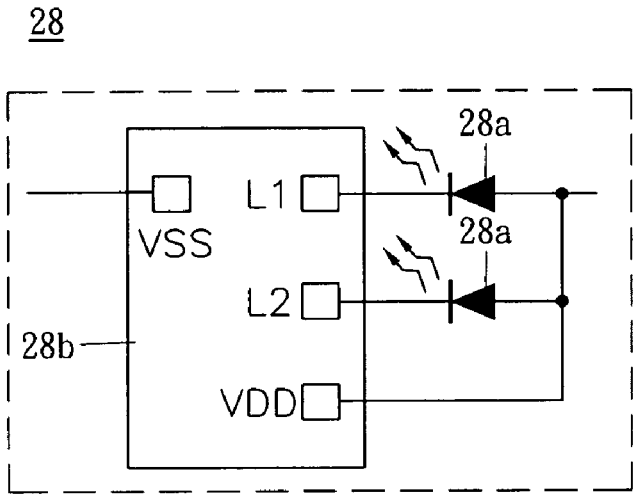
FIG. 5 is a schematic drawing to illustrate the structure of dual color LED flash bulb provided with two LED chips of different color and an IC driving element for driving the two LED chips.

Referring to FIG. 5, a dual color LED flash bulb 28 comprises two LED chips 28*a* of different color and an IC driving element 28*b*, and the two LED chips 28*a* are controlled by the IC driving element 28*b* to generate dual color light and undergo ON-OFF variation.

Figure 6:
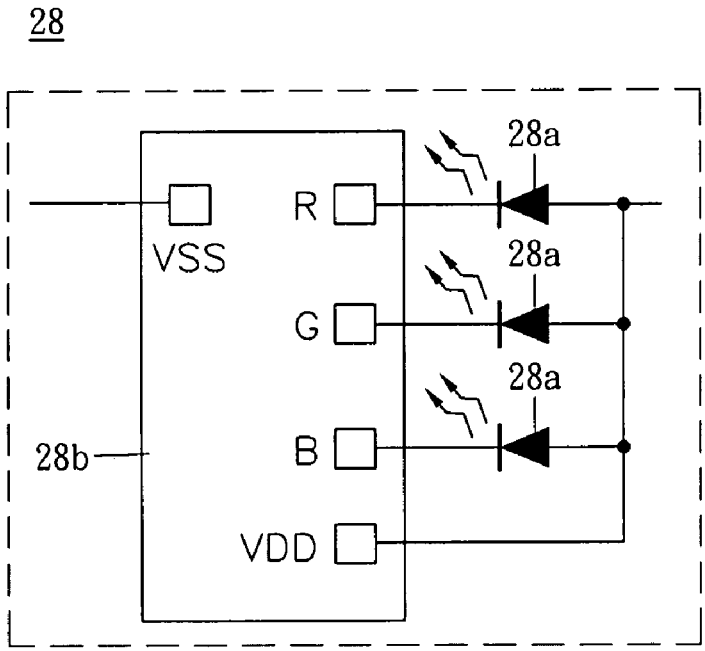
FIG. 6 is a schematic drawing to illustrate the structure of a multiple color LED flash bulb provided with three LED chips of red, green and blue color and an IC driving element for driving the three LED chips.

Referring to FIG. 6, a multiple color LED flash bulb 28 comprises three LED chips 28*a* of red, green and blue color and an IC driving element 28*b*, and the three LED chips 28*a* are controlled by the IC driving element 28*b* to generate multiple color light and undergo ON-OFF variation.

According to practical needs, the different IC driving element 28*b* may be independently designed to possess different ON-OFF flash timing sequence to drive corresponding single or multiple colors LED chip(s) 28*a*.

Hence, by employing power reset function as well as in combination of different single or multiple color LED flash bulbs 28 which has been installed with either identical or different IC driving element 28*b* to drive corresponding LED chip(s) 28*a* to emit same color or different color of LED light in either identical or different time intervals, the LED flash bulb decorating light 20 of the invention is so easily assembled with a series of different single color, dual color or multiple color LED flash bulb 28 capably emitted a variety of different LED light pattern during different ON-OFF flashing timing sequence.

For example, when the LED flash bulb decorating light 20 of the invention is arranged to perform a timing control diagram which has the programmed relationship of light variation versus timing sequence (hereinafter called LED light-program play) shown in FIG. 7, the eight single color LED flash bulbs 28 with different specifications, a power cord 21 and a circuit control box 23 shall be assembled to form the LED flash bulb decorating light 20 as shown in FIG. 2, wherein the power reset circuit 26 of the circuit control box 23 can automatically reset power supply at the repeated setting time interval "T". And each single color LED flash bulb 28 comprises a single color LED chip 28*a* and an IC driving element 28*b*. However different single color flash bulb 28 shall have different IC driving element 28*b* with different specifications, and different IC driving element 28*b* for lightening the corresponding LED chip 28*a* has different time delay of 1 second, 2 seconds, 3 seconds, 4 seconds, 5 seconds, 6 seconds and 7 seconds.

Figure 8:
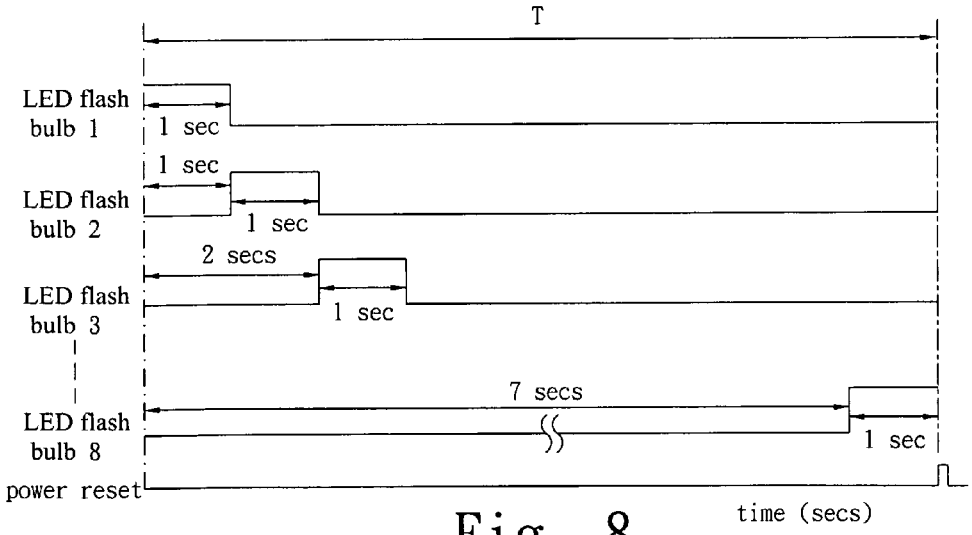
FIG. 8 is another timing control diagram as well as an executing power reset functional diagram to show the relationship of light variation versus timing sequence if it is applicable to the LED flash bulb decorating light of the invention.

Similarly, when LED light-program play arranged as shown in FIG. 8 is to be performed, a LED flash bulb decorating light 20 shown in FIG. 2 shall be constructed by the same way to include eight single color LED flash bulbs 28, a power cord 21 and circuit control box 23, wherein the power reset circuit 26 of the circuit control box 23 will reset power supple repeatedly at the setting time interval "T". Each single color LED flash bulb 28 comprises a single color chip 28*a* and an IC driving element 28*b*. The IC driving element 28*b* for different single color LED flash bulb 28 shall have different specifications, and each LED flash bulb chip 28*a* shall be lightened by different IC driving element 28*b* with time delay of 1 second, 2 seconds, 3 seconds, 4 seconds, 5 seconds, 6 seconds and 7 seconds, and the duration of light is only 1 second.

Figure 9:
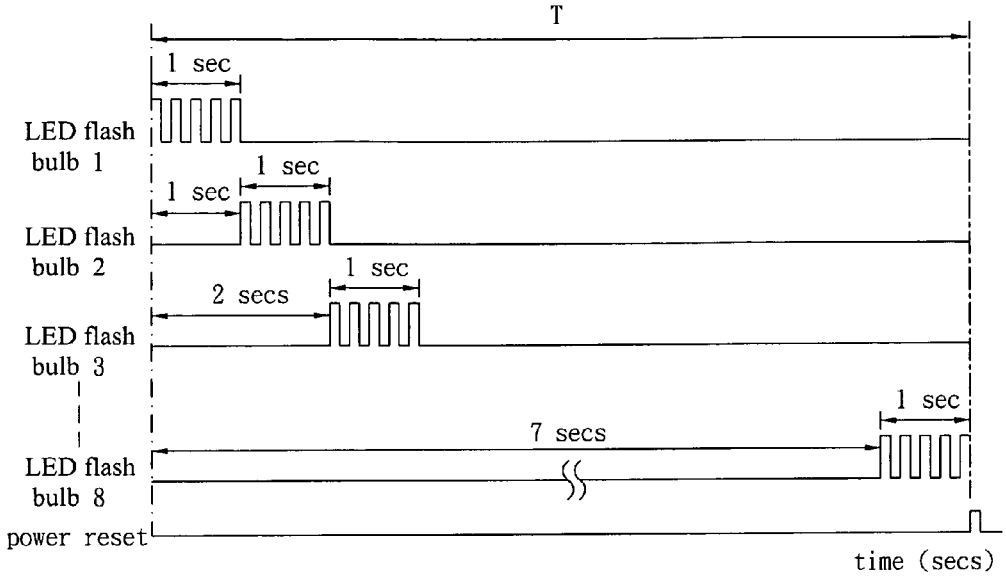
FIG. 9 is still another timing control diagram as well as an executing power reset functional diagram to show the relationship of light variation versus timing sequence if it is applicable to the LED flash bulb decorating light of the invention.

Similarly, when LED light-program play arranged as shown in FIG. 9 is to be performed, a LED flash bulb decorating light 20 shown in FIG. 2 shall be constructed by the same way to include eight single color LED flash bulbs 28, a power cord 21 and a circuit control box 23, wherein the power reset circuit 26 of the circuit control box 23 will reset power supply repeatedly at the sitting time interval "T". Each single color LED flash bulb 28 comprises a single color chip 28*a* and an IC driving element 28*b*. The IC driving element 28*b* for different single color LED flash bulb 28 shall have different specifications, and each LED chip 28*a* shall be lightened by different IC driving element with time delay of 1 second, 2 seconds, 3 seconds, 4 seconds, 5 seconds, 6 seconds and 7 seconds, and the frequency of light flash is 5 times per second.

Figure 7:
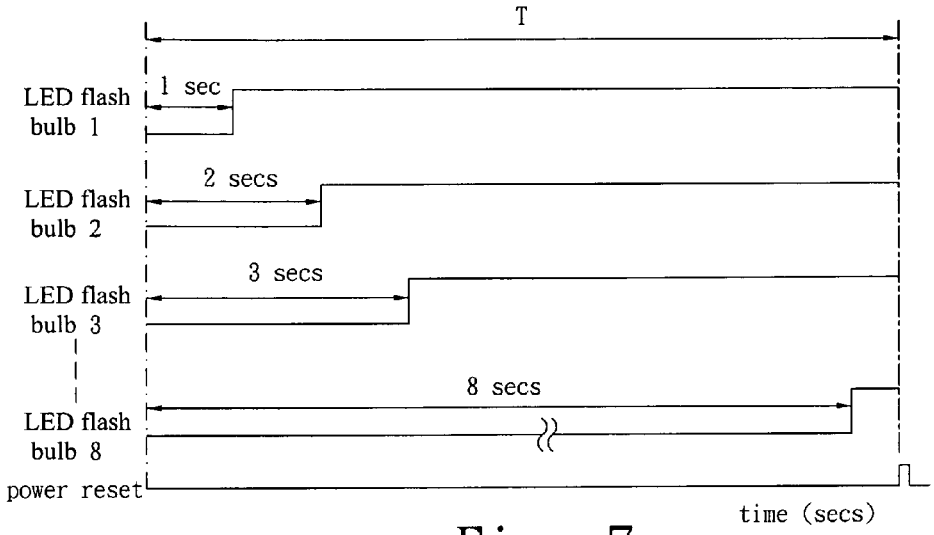
FIG. 7 is a timing control diagram as well as an executing power reset functional diagram to show the relationship of light variation versus timing sequence if it is applicable to the LED flash bulb decorating light of the invention.

The LED flash bulb decorating light 20 of the invention is arranged according to the LED light-program play shown in FIG. 7. FIG. 8 or FIG. 9, when connected to power source through power plug 22 of power cord 21, those eight LED flash bulbs 28 will be lightened in sequence according to the LED light-program play arranged in FIG. 7, FIG. 8 or FIG. 9 to generate light variation.

Normally, the light variation timing sequence of the LED flash bulb 28 assembled on the LED flash bulb decorating light 20 of the invention will gradually present delay as compared with the desired LED flash bulb play after a period of working. Therefore, the purpose of executing power reset by the circuit control box 23 at a repeated time interval is to restart the LED flash bulb 28 according to the arrangement of the LED light-program play to obtain the desired sequence of light variation to prevent any timing delay.

Figure 10:
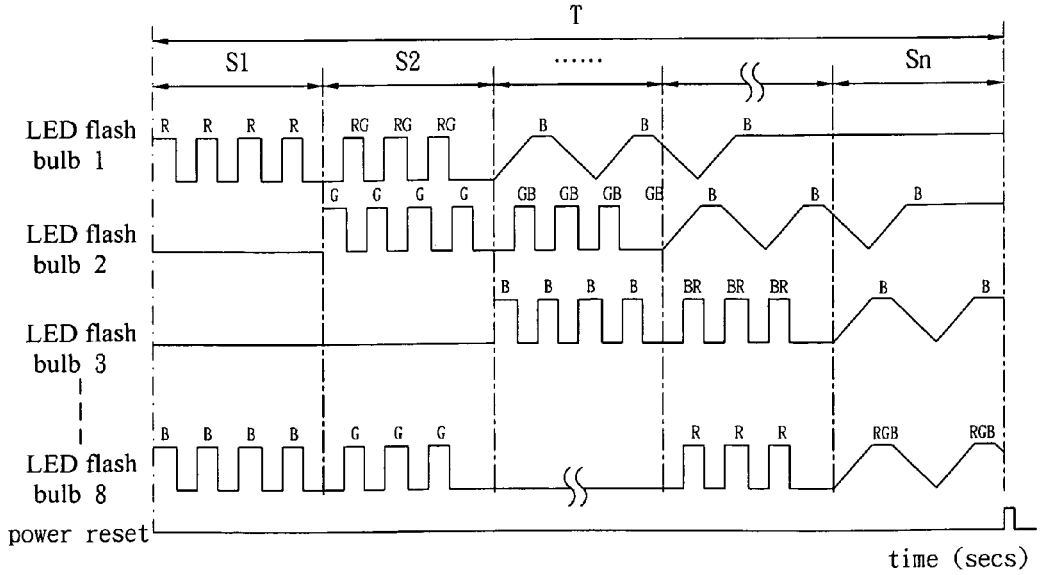
FIG. 10 is another further timing control diagram as well as an executing power reset functional diagram to show the relationship of light variation versus timing sequence if it is applicable to the LED flash bulb decorating light of the invention.

Based on the above, if the LED light-program play shown in FIG. 10 is to be performed, "n" pieces of multiple color LED flash bulb 28, a power cord 21 and a circuit control box 23 shall be used to construct a LED flash bulb decorating light 20 as shown in FIG. 2, wherein the power reset circuit 26 of the circuit control box 23 will automatically reset power supply at a repeated setting time interval "T". Each multiple color LED flash bulb 28 comprises three LED chips 28*b* of red, green and blue color and an IC driving element 28*b*, but the IC driving element 28*b* for different multiple color flash bulb 28 has different specifications.

For example, an IC driving element 28*b* is for lightening the red color LED chip 28*a* in time interval "S1" to generate light flash in red color, and lightening the red and green color LED chips 28*a* at the same time in "S2" time interval to generate the light flash in mixed color of red and green, and lightening the blue color LED chip 28*a* to generate light flash in blue color. Another driving element 28*b* is for lightening the blue chip 28*a* in time interval "S1" to generate light flash in blue color, and lightening green color LED chip 28*a* in the same time interval "S2" to generate light flash in green color, also in time interval "Sn" lightening the red, green and blue color LED chip 28*a* to generate gradually brightened light and then darkened light of a mixture of red, green and blue color.

As illustrated in FIG. 10 each multiple color LED flash bulb 28 undergoes light variation independently in time interval "S1", "S2" . . . "Sn" according to the corresponding LED light-program play. In order to prevent the occurrence of timing delay, the circuit control box 23 of the LED flash bulb will reset power supply to enable each multiple color LED flash bulb 28 to restart independent light variation sequence according to LED light-program play to achieve the desired synchronism of light variation.

What is claimed is:

1. A LED flash bulb decorating light comprising a power cord with a power plug, a series of single color or/and multiple color LED flash bulbs forming in series or parallel circuit with the power cord and a circuit control box installed between the power plug of the power cord and the LED flash bulbs, wherein the circuit control box comprises a low pass filter circuit and a power reset circuit, and the low pass filter circuit comprises a diode D1, a resistor R1 and capacitor C1, an AC current input from the power plug of the power cord is rectified by the diode D1, and filtrated by the filter of R1 and C1 to become DC current; and the power reset circuit comprises a power reset IC element and two transistors Q1 and Q2 to supply DC current to the single color or multiple color LED flash bulb and to execute power reset at a repeated setting time interval.

2. The LED flash bulb decorating light as described in claim 1, wherein the LED flash bulb comprises a single color LED chip and an IC driving element for driving the LED chip with DC power to generate single color light variation.

3. The LED flash bulb decorating light as described in claim 1, wherein the LED flash bulb comprises two LED chips of different color and an IC driving element for driving the two LED chips with DC power to generate dual color light variation.

4. The LED flash bulb decorating light as described in claim 1, wherein the LED flash bulb comprises three LED chips of red, green and blue color and an IC driving element for driving the three LED chips with DC power to generate multiple color light variation.

5. The LED flash bulb decorating light as described in claim 1, wherein the circuit control box further comprises a zener circuit for stabilizing a DC power.

6. The LED flash bulb decorating light as described in claim 5, wherein the LED flash bulb comprises a single color LED chip and an IC driving element for driving the LED chip with DC power to generate single color light variation.

7. The LED flash bulb decorating light as described in claim 5, wherein the LED flash bulb comprises two LED chips of different color and an IC driving element for driving the two LED chips with DC power to generate dual color light variation.

8. The LED flash bulb decorating light as described in claim 5, wherein the LED flash bulb comprises three LED chips of red, green and blue color and an IC driving element for driving the three LED chips with DC power to generate multiple color light variation.

9. The LED flash bulb decorating light as described in claim 1, wherein the power cord further comprises a power socket for supplying DC power.

* * * * *